US005791252A

United States Patent [19]

Egan

[11] Patent Number: 5,791,252

[45] Date of Patent: Aug. 11, 1998

[54] METHOD AND STAMPING DEVICE FOR CREATING AN ALIGNED DESIGN

[75] Inventor: Colleen A. Egan, Matawan, N.J.

[73] Assignee: CPE, Inc., Matawan, N.J.

[21] Appl. No.: 943,100

[22] Filed: Aug. 27, 1997

Related U.S. Application Data

[63] Continuation-in-part of Ser. No. 563,282, Nov. 22, 1995, abandoned.

[51] Int. Cl.[6] ..... B41F 1/34

[52] U.S. Cl. ..... 101/485; 101/483; 101/DIG. 36

[58] Field of Search ..... 101/485, 486, 101/483, DIG. 36, 334, 333, 327, 373, 372, 129, 125, 114; 427/256, 282

[56] References Cited

U.S. PATENT DOCUMENTS

| | | | |
|---|---|---|---|
| 2,651,871 | 9/1953 | Lynden | 427/282 |
| 3,661,078 | 5/1972 | Hammel | 101/125 |
| 3,817,178 | 6/1974 | Hagen | 101/327 |
| 3,886,863 | 6/1975 | Carabott et al. | 101/125 |
| 3,894,487 | 7/1975 | Miller | 101/129 |
| 4,048,918 | 9/1977 | Peck | 101/114 |
| 4,432,281 | 2/1984 | Wall et al. | 101/334 |
| 4,625,640 | 12/1986 | Bunger | 101/327 |
| 4,852,489 | 8/1989 | Wall et al. | 101/334 |
| 4,986,175 | 1/1991 | Boehringer et al. | 101/125 |
| 4,996,735 | 3/1991 | Blankenship | 101/373 |
| 5,460,087 | 10/1995 | Ogorzaled | 101/112 |
| 5,471,930 | 12/1995 | Wood | 101/372 |

*Primary Examiner*—Edgar S. Burr
*Assistant Examiner*—Anthony H. Nguyen
*Attorney, Agent, or Firm*—Lerner, David, Littenberg, Krumholz & Mentlik

[57] ABSTRACT

A method and apparatus for forming a design on a surface is disclosed. The method comprises the steps of selecting a surface on which a design is to be formed, placing a stamping device at a selected location on the surface, depressing the stamping device against the surface at the selected location so that a segment of a first portion of a design is formed, moving the stamping device to a different selected location on the surface spaced a desired distance from the initial selected location, registering the stamping device depressing the stamping device against the surface at the different selected location so that an additional segment of the first portion of the design is formed, and repeating the steps of moving the stamping device to a different location and depressing the stamping device until a desired length of the first portion of the design is completed on the surface. One or more addition design portions may be superimposed on top of the first design portion. The apparatus comprises a stamping device having a registration design thereon which is arranged to overlay at least a portion of a previously formed design in order to facilitate proper alignment of adjacent design segments.

27 Claims, 12 Drawing Sheets

METHOD AND STAMPING DEVICE FOR CREATING AN ALIGNED DESIGN

This application is a continuation-in-part of application Ser. No. 08/563,282 which was filed on Nov. 22, 1995 now abandoned.

FIELD OF THE INVENTION

The present invention relates to a method of forming a design on a surface. More particularly, the present invention pertains to a method of using a stamping device to form an aligned design on a wall or other surface. The present invention also pertains to the structure of a stamping device which can be used to create such design.

BACKGROUND OF THE INVENTION

Great effort has been expended by interior decorators, homemakers, and others in decorating homes, offices and other areas. The individuals involved in such decorating will be referred to as "decorators" herein. Prior art decorators have expended particularly large efforts in decorating wall surfaces, and other surfaces such as the surfaces of furniture, floors, cabinets, and the like.

In order to make various surfaces in a room more attractive, decorators have heretofore used flexible stencil sheets to paint a repetitive design on a desired surface. For example, in creating a border design around the top surface of the walls of a room, prior art decorators have previously needed a great deal of artistic ability to create a neatly painted design within cut-out areas on a flexible stencil sheet. In a typical scenario in which a prior art decorator used stencils to create a design on a room border, the decorator was required to paint a first segment of a design at a selected location on a wall surface. When the first segment was completed, the prior art decorator was required to remove the flexible stencil sheet and place it at a second location on a wall surface adjacent to the first location so that an additional segment of a design could be painted adjacent to the first design segment. The flexible stencil sheet may have one or more registration marks which should be precisely placed over a portion of the previously formed design segment. When the second design segment was completed, the prior art decorator was required to again move the flexible stencil sheet to a third location which was adjacent the second location. This process was typically repeated many times until the entire border of a room was painted with a first portion of a desired design. The first portion typically included one color.

In order to complete the stenciled border design, the prior art decorator was then required to obtain a second flexible stencil sheet having a different design than the first flexible stencil sheet. The first portion of the design was permitted to dry. Thereafter, the second stencil sheet was then placed on top of a preselected location of a previously created segment of the first portion of the design, and the prior art decorator painted the cut-out areas over the second stencil sheet so that a segment of a second portion of a design was superimposed on a segment of the first portion of the design. This procedure was then repeated many times until all segments of the second portion of the design were painted on top of corresponding segments of the first portion of the design.

Typically, the second portion of the design included a different color than the first portion of the design. For example, if the decorator desired to create a border design comprising a plurality of red and yellow flowers, each of the first and second stencil sheets would be representative of one of the colored flowers.

The aforementioned process of stenciling a design around the top of the walls of a room to create a painted border was time consuming and required a great deal of patience and skill on the part of the decorator.

Although the end result of a stenciled design is quite attractive and significantly enhances the appearance of a room or an object, many homemakers and decorators do not use stencils to create designs because of the large skill and time commitment required. Accordingly, many homemakers and decorators choose to use wallpaper to create a border around the top portion of the walls of a room. To this end, a wallpaper border requires much less skill and time to form a completed border design.

Notwithstanding the timesaving that may be obtained by using a wallpaper border, as opposed to a prior art stenciled border, many decorators do not like wallpaper borders as such borders are not as aesthetically pleasing as border designs created by stencils. Further, wallpaper is often difficult to remove from a wall surface and is therefore undesirable to many decorators.

Other inventors have also made efforts to provide a stamping device which could be used to create ornamental designs on wall surfaces. For example, U.S. Pat. No. 3,817,178 to Hagen discloses a stamping pad formed of an open-cell plastic foam which can be used to create a continuous design on a wall or ceiling. The device disclosed in the '178 patent includes a chain and a hook which is used in combination with chalk lines to permit alignment of the foam stamping pad with a previously formed design. It is cumbersome and inefficient to obtain proper alignment of the stamping device disclosed in the '178 patent.

U.S. Pat. No. 5,471,930 to Wood discloses a rubber stamp which can be used to create a multi-part design on a surface. The '930 patent fails to disclose or teach an alignment mechanism for assuring proper registration of each part of an overlapped design and adjacent design segments.

U.S. Pat. No. 4,625,640 to Bunger discloses a series of stamping devices which are used in combination with each other and with a registration mechanism in order to form a multi-part design at a single location. Although the stamping device is disclosed in Bunger, can apparently be used to create a superimposed design, it fails to disclose or teach how adjacent design segments can be aligned with respect to each other.

Accordingly, the prior art method of creating border designs by stenciling, stamping and wallpapering have various shortcomings. The present invention addresses the shortcomings of the prior art as it provides decorators with a simple method of creating a continuous design on a wall surface which is less time consuming and cumbersome and requires less skill than the prior art methods while retaining the same highly desired appearance created when a painted stencil design is formed on a surface.

SUMMARY AND OBJECTS OF THE INVENTION

In accordance with a first aspect of the present invention, a method of forming a design on a wall is provided. The method in accordance with this aspect of the present invention comprises the steps of selecting a wall surface on which a design is to be formed. A stamping device is then placed at an initial selected location on the wall surface. The stamping device may then be depressed against the wall surface at the initial selected location so that a segment of a first portion of the design is formed. Thereafter, the stamping device is moved to a different selected location on the wall surface spaced a desired distance from the initial selected location. This desired distance may be immediately adjacent the initial selected location or may be at a predetermined spaced distance from the initial selected location. A portion of the stamping device, including a registration design thereon, is arranged to overlap a portion of the previously formed segment so that the stamping device is aligned with the previously formed segment. The stamping device is then again depressed against the wall surface at the different selected location so that an additional segment of the first portion of the design is formed. If necessary, the steps of moving the stamping device to a different selected location, aligning and depressing the stamping device are repeated until the first portion of the design is at least substantially completed on the wall surface.

It is preferable for the first portion of the design to be substantially continuous along the entire surface on the wall on which it is formed. The term "substantially continuous" is intended to cover designs which include a repetitive pattern on a surface as well as designs which are entirely continuous. The pattern may continue along a portion of the surface to which it is applied, or may continue along the entire surface on which it is applied. Thus, the design may be substantially continuous if each segment of the design is the same as the following segment of the design. The following segment may be formed immediately adjacent to the preceding segment, or may be formed at a spaced distance from the preceding segment.

The stamping device used in accordance with the present method includes an alignment mechanism, which preferably includes a registration design (i.e., a registration mark). The present method may comprise the step of arranging the registration design of the stamping device at a preselected location on a wall surface so that it overlays a previously formed design segment prior to depressing the stamping device so that each segment of a first portion of the design is formed at a desired aligned location on the wall surface.

In one preferred embodiment, the registration design may comprise a cut-out in portion of a casing of the stamping device. In another preferred embodiment, the registration design may comprise a marked design which may be etched or drawn, on a portion of a translucent casing of the stamping device. The registration design may also be arranged on an associated stencil sheet, or any other registration device which facilitates proper placement of the stamping device on the surface on which the design is formed. As used herein, it should be appreciated that the terms "registration design" and "registration marks" are synonymous.

A method in accordance with a preferred embodiment of the present invention pertains to forming the border design on one or more walls of a room. To this end, the border design may be formed on only one wall of a room, or it may be formed on every wall of the room. Preferably, each segment of a first portion of the border design is formed substantially adjacent at least one other segment of the first portion of the border design by aligning each design segment with a previously formed design segment by overlaying the registration design of the stamping device above the previously formed design segment. When the first portion of the border design is substantially completed on a wall surface, it may be necessary to determine the distance between the end of the last segment of the substantially completed first portion of the border design on the wall surface and a corner of the room in which the border design is being formed. This step of the present method is particularly necessary where it is desired to form a custom sized segment of the border design so that the first portion of the design will be substantially continuous along the entire surface of the wall to which it is applied upon completion. In accordance with this preferred method of the present invention, an additional design forming device may be placed on the wall surface over the determined distance where it is desired to form the custom sized design segment. The custom sized design segment may then be formed on the wall surface whereby the first portion of the substantially continuous design is completed along the entire surface of the wall to which it is applied.

The additional design forming device may comprise a flexible stencil sheet having the desired custom sized design segment thereon. The steps of placing the additional design forming device on the wall surface and applying the custom sized design segment comprises arranging the flexible stencil sheet at the desired location on the wall and applying a liquid marking composition to at least some of the cut-out areas of the flexible stencil sheet so that the custom sized design segment is formed on the wall surface between the end of a previously formed design segment and the intersection with an adjacent wall so that the first portion of the substantially continuous border design is completed on the wall surface on which it is formed. Alignment of the flexible stencil sheet and the adjacent design segment may be performed by using registration marks on the stencil sheet. Since only one custom sized design segment is usually required for each wall, alignment may also be accomplished by estimation based on the skill of the designer. When this aspect of the present invention is utilized, it should be appreciated that the present invention has greatly improved upon the prior art method of forming a stencil design by using a stamping device to form the design along substantially the entire length of a wall surface to which the design is applied so that substantial timesaving may be obtained. The present method takes advantage of the flexible nature of prior art stencils to fill in a portion of the design which may be smaller than the design arranged on the stamping device.

The present invention also contemplates using the stamping device to form a border design along an entire wall surface without requiring use of a flexible stencil sheet to complete the design. To this end, the length of the design may be preplanned so that it fits perfectly along the wall surface. In another preferred embodiment, a blank sheet may be placed under a portion of the stamping device when it is desired to form the custom sized segment of the design which may be smaller than the length of the design on the stamping device. In particular, the stamping device may be placed over the area on the wall surface where it is desired to form a custom sized design. A blank sheet may be arranged beneath a portion of the stamping device, and the stamping device may then be depressed so that the segment of the design formed will be applied to the custom sized area on the wall surface while the blank sheet will prevent the additional length of the design from being superimposed on an adjacent segment which was previously formed on the wall surface.

In accordance with a preferred aspect of the present invention, a method is used to form a border design on a wall surface wherein the border design comprises a plurality of colors. In accordance with this preferred method, a first stamping device can be used to form the first portion of the design. The first portion of the design preferably comprises a plurality of segments wherein each segment is identical to a previously formed segment in both configuration and color. After a first portion of the design has been formed along the desired wall surface, a second stamping device may be used to superimpose a second portion of the border design on the first portion thereof. The second portion of the border design may also comprise a plurality of segments which are identical to each other in both configuration and color. Each of the segments of the second portion of the border design may complement the segments of the first portion of the border design. For example, the first portion of the border design may comprise green leaves of an ivy plant, while the second portion of the border design may comprise brown stems of the ivy plant so that an overall design is formed.

In another preferred embodiment, a border design may comprise more than two portions. In this preferred embodiment, each portion of the border design may comprise a different configuration and color. For example, a border design may include red buildings, blue buildings, green buildings, and brown buildings. Such a border design may be said to have four portions. The first portion would comprise a plurality of identical segments to form a continuous length of red buildings. The second portion of the border design would also comprise a plurality of identical segments to form a continuous length of blue buildings. The third portion of the border design would comprise a plurality of identical segments to form the green buildings, and the fourth portion of the border design would comprise a plurality of identical segments which form a continuous length of brown buildings.

In accordance with a further preferred method, a multicolored design having a repetitive pattern may be formed on various surfaces. These surfaces may comprise the surface of furniture, floors, cabinets, walls, and the like. In accordance with this aspect of the present invention, it is important that the design formed has a repetitive pattern and that each portion of the design comprises at least two segments which are preferably placed adjacent to each other. In accordance with this preferred method, each portion of the design will be superimposed on a previously applied portion so that the superimposed portions combine to form an overall desired design.

Another aspect of the present invention relates to the structure of a stamping device which can be used to form a design on a surface. The stamping device may comprise an impression member for forming design segments on a surface. A casing may also be provided which is connected to the impression member, where the casing includes an extended portion arranged to extend beyond the impression number when forming a design segment. The extended portion may include a registration design thereon which is adapted to overlay at least a portion of a previously formed design segment for facilitating the alignment of the stamping device with the previously formed design segment.

In a preferred embodiment, the stamping device may include a handle attached to the casing at an opposing side from the impression member.

The registration design on the extended portion of the casing may comprise a cut-out design arranged to extend through a preselected location of the extended portion. The registration design may also comprise an etched or drawn design. In this embodiment, the extended portion of the casing is preferably substantially translucent in order to permit the user to align a previously formed design with the etched or drawn registration design on the translucent casing in order to obtain proper alignment of the stamping device prior to creating a further design impression.

In a preferred embodiment, the impression member may comprise a rubber marking structure. The impression member may also comprise a pre-inked microporus material. Still further, the marking structure may comprise an absorbent material suitable for retaining a design amount of marking fluid.

The stamping device of the present invention may also comprise a stencil stamp having a unique alignment mechanism. In one embodiment, the stamping device may comprise a body and an absorbent marking fluid applying surface arranged on the body. A stencil sheet may be removable attached to the body and may be arranged adjacent to the marking fluid applying surface. The stencil sheet may include cut-out design areas for permitting a design to be formed on a surface. The stencil sheet may further include and extended portion having a registration design thereon which is adapted to overlay a portion of a previously formed design segment for facilitating alignment of the stamping device with a previously formed design segment.

In a preferred embodiment, the stencil stamping device may comprise a handle attached to a side of the body which opposes the absorbent marking fluid applying surface. In this embodiment, the registration design may comprise a cut-out design arranged a preselected location on the extended portion of the stencil sheet. In alternate embodiments, the registration design may comprise an etched design or a design drawn at a preselected location on the extended portion of the stencil sheet.

Accordingly, it is an object of the present invention to form an aesthetically pleasing design on a surface, such as a wall surface and the like, wherein the design may be formed in a much quicker manner than has yet heretofore been achieved when forming similar designs with prior art methods.

It is another object of the present invention to provide a method of forming a design on a surface, such as the border of a room, wherein the decorator applying the design need not possess a great deal of artistic ability.

It is yet another object of the present invention to provide a stamping device which can be quickly and easily aligned with a previously formed design segment by overlaying a portion of the stamping device including a registration design thereon with at least a portion of the previously formed design segment in order to obtain proper alignment of the stamping device prior to forming a further design segment on a surface.

These and other objects and features of the present invention will be more clearly understood when considered in conjunction with the following detailed description of the preferred embodiments and drawings of the present invention.

DETAILED DESCRIPTION OF THE PREFERRED EMBODIMENTS

Various types of stamping devices can be used in accordance with the present method of forming a design on a surface. Examples of several stamping devices will be discussed herein. However, it should be understood that the present invention is not limited to the particular type of stamping device used. The novel and unobvious aspects of the present stamping device relates to an extended portion having a registration design thereon which is adapted to overlay at least a portion of a formed design segment to facilitate alignment.

Another aspect of the invention is directed toward a method of creating a design on a surface, where alignment of the design segments are efficiently and accurately obtained on the surface by using various types of stamping or imprinting devices. As used herein, the term "stamping device" is intended to include any marking device which can be used to create a design on a surface upon movement of the marking device from a non-marking position where at least a portion of the marking device is remote from the surface to be marked to a marking position where the marking device contacts the surface and thereby forms a design upon transfer of marking fluid.

Further, although the term "wall surface" will be often used herein to describe the surface to which a design is applied, it should be understood that the present method is applicable to various surfaces including the surface of furniture, cabinets, floors, and the like. The term "wall surface" has been chosen because one application of the present invention pertains to forming a design on the border of a wall to provide a decorative appearance around the border of a room. It should also be understood that the border area of a wall may pertain to the top portion of the wall adjacent to a ceiling in a room, or may pertain to a lower area on a wall, such as the area immediately above or below a chair rail.

Figure 1:
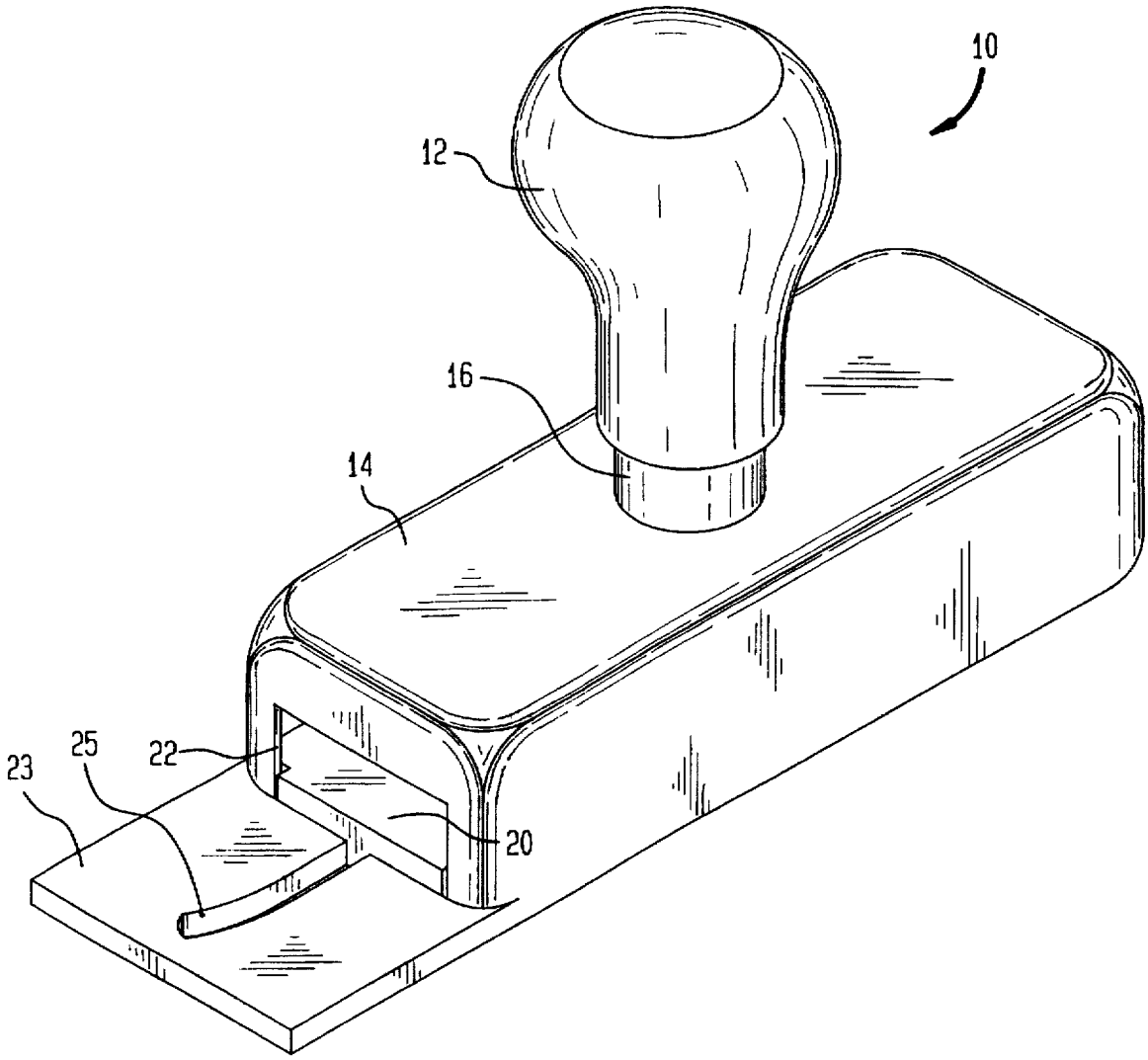
FIG. 1 is a perspective view of one embodiment of a stamping device which may be used with the method of the present invention.

A first embodiment of a stamping device which can be used in accordance with the present method of forming a design is shown in FIG. 1. This stamping device may be a pre-inked stamp having a microporous marking structure which is impregnated with a marking fluid such as ink. As illustrated in FIG. 1, the pre-inked stamp 10 includes a handle 12, a base housing 14, and a neck area 16 arranged between the handle 12 and the base housing 14. The neck 16 may include an adjustment mechanism which permits the stamp to be set for lighter or darker impressions.

An inner frame (not shown) for supporting a marking structure may be arranged within the base housing 14 of the pre-inked stamp 10. A microporous marking structure 20 having microscopic ink holding cells is arranged within the base housing 14 for movement between a retracted position and an extended position at which it may imprint a design onto a surface. FIG. 1 illustrates the marking structure in its marking position, which may be obtained upon depression of handle 12. The microscopic ink cells and the porous nature of the marking structure 20 permit sufficient ink to be retained within the marking structure 20 to produce thousands of impressions before the ink supply within the marking structure 20 is exhausted. In the embodiment shown in FIG. 1, a rectangular opening 22 is arranged within opposing side walls of the base housing 14 so that a portion of the marking structure 20 can extend to the outer most portion of the base housing 14. As will be discussed further below, the purpose of the optional rectangular open area 22 is to permit the formation of an entirely continuous design when using a pre-inked stamp having a base housing.

A design (not shown) including marking indicia may be formed on the face of the marking structure 20 so that the desired design can be imprinted upon depression of the handle 12 of the pre-inked stamp 10. A dust cover (not shown) may be arranged on the base 14 of the pre-inked stamp 10. The dust cover is designed to protect the marking structure of the stamp so that the ink will be prevented from coming into contact with the surface when it is not desirable to use the stamp.

It should be appreciated that the term "ink" as used herein pertains to a liquid marking composition for creating a desired design. Common usage of the term "ink" differs from common usage of the term "paint" because the vehicle or medium which carries the pigment is different. Paints typically include various amounts of resin, while most inks typically do not include resin. However, as used herein, the term "ink" is intended to cover inks, as well as paints, and various other liquid marking compositions which can be used to create a design.

One type of pre-inked stamp which is commercially available and which may be modified for use in accordance with the method of the present invention is sold by M&R Marking Systems Inc. of Piscataway, N.J. under the trademark ROYAL MARK. If it is desired to create a completely continuous design where each design segment is joined to an adjacent segment, a modified pre-inked stamp may be used. FIG. 1 illustrates such a modified stamp which has a marking structure 20 which extends through open area 22 in the sides of the base housing 14 so that the overall width of the design is the same as the width of the housing. Another modification, which is an important aspect of this embodiment of the present invention pertains to the use of extended portion 23 which is connected to the base housing (i.e. casing) 14. A registration design 25, which is shown in FIG. 1 as comprising a cut-out slot portion of a design is arranged to extend completely through a selected area of the extended portion 23. As discussed further below, this aspect of the present invention is used to obtain accurate and efficient alignment of adjacent design segments.

Figure 12A:
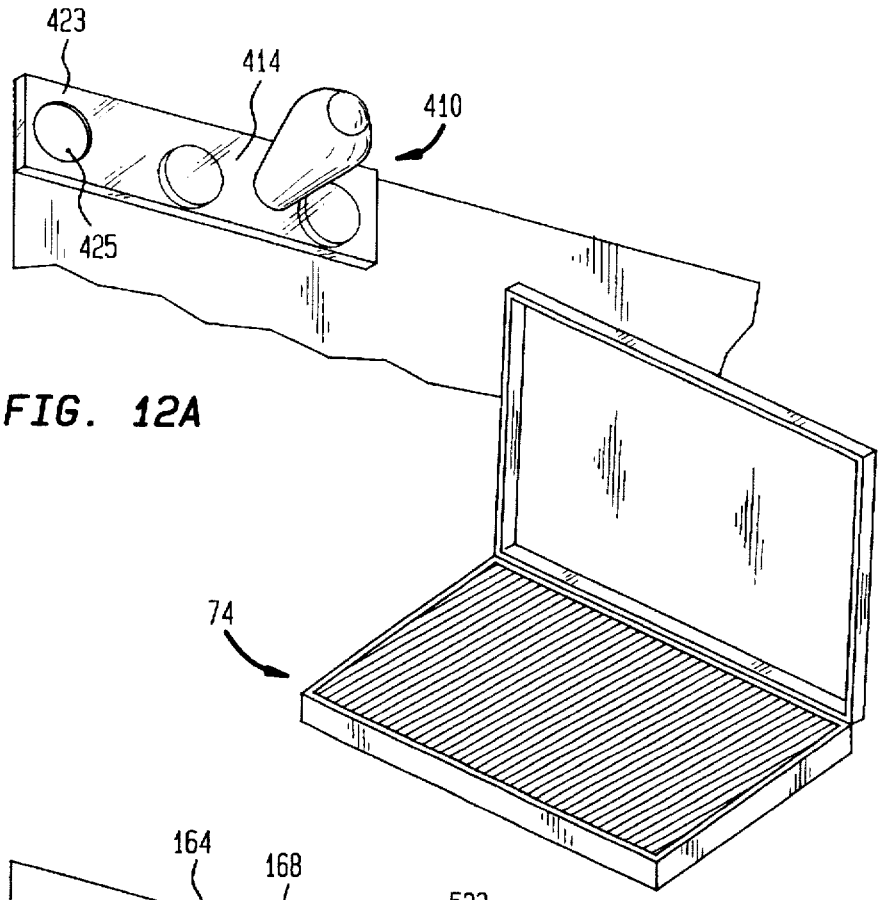
FIG. 12A illustrates yet another embodiment of a stamping device which is used to from a first portion of a design.
Figure 12B:
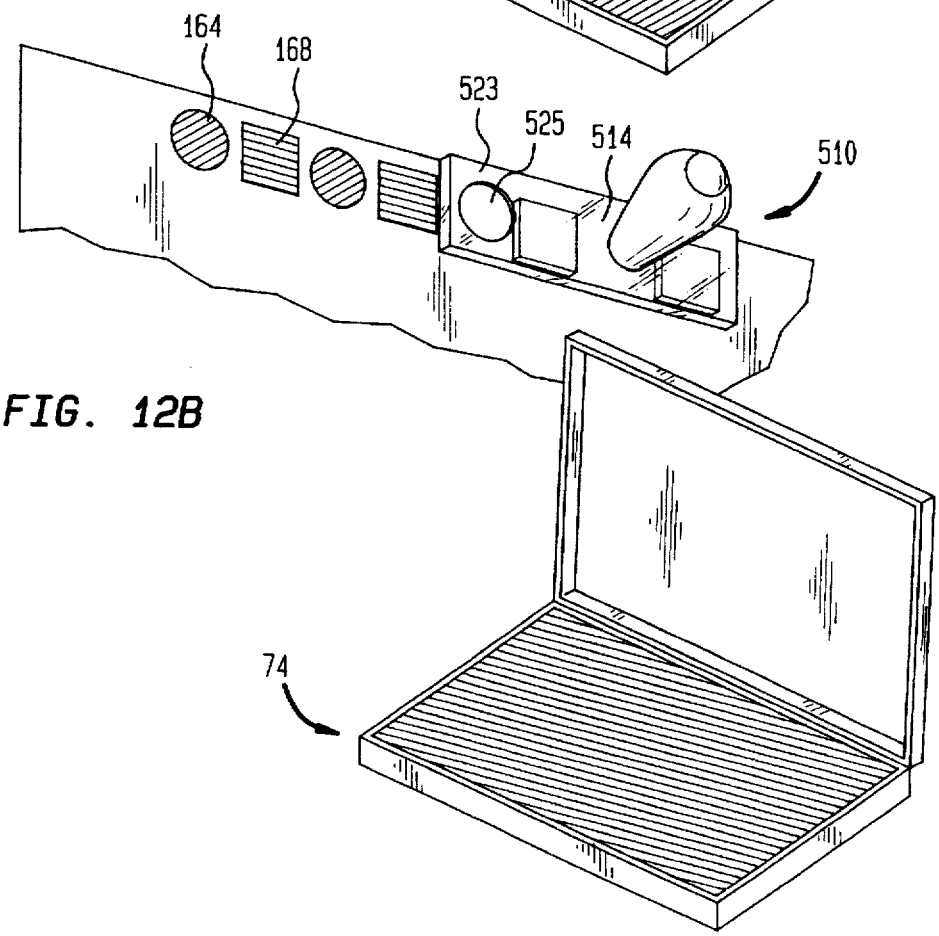
FIG. 12B illustrates a related stamping device to the device shown in FIG. 12A which is used to create a second portion of the overall design.

Alternatively, a stamping device having a rubber marking structure may be used instead of a pre-inked stamp. When a rubber marking structure is used, it is necessary to apply a marking fluid to the external service of the design forming members on the face rubber stamp. The marking fluid may be applied by rolling a suitable paint, or the like, thereon. The marking fluid may also be applied to the rubber stamp by various other application techniques such as dapping the rubber stamp on an external ink pad 74 as shown in FIGS. 12A and 12B.

Figure 2:
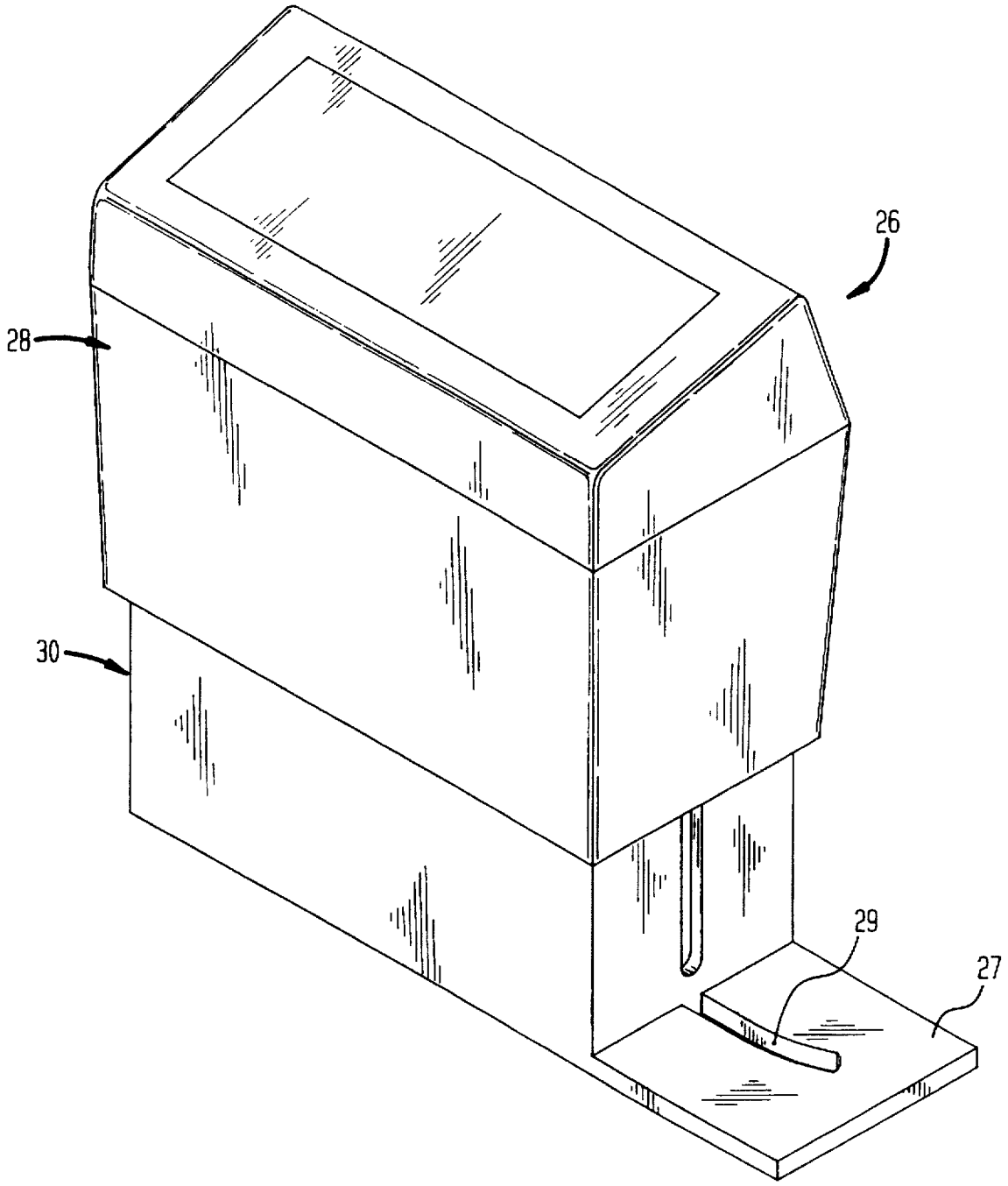
FIG. 2 is a perspective view of another embodiment of a stamping device which may be used with the method of the present invention.

A third type of stamping device which may be used in accordance with the present invention is a self-inking stamp. One embodiment of a self-inking stamp is shown in FIG. 2. M&R Marking Systems also manufactures and markets self-inking stamps under the trademark IDEAL which can be modified for use in accordance with the present invention.

Figure 3:
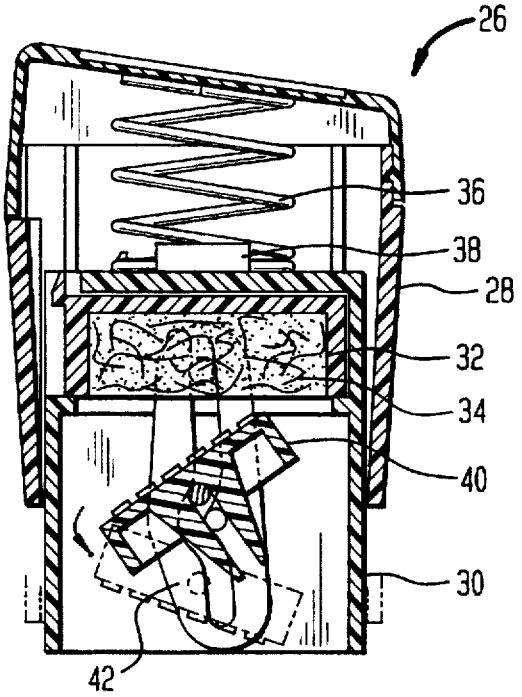
FIG. 3 is a cross sectional view taken along line III—III of the stamping device shown in FIG. 2

As shown in FIGS. 2 and 3, a self-inking stamp 26 may include an outer housing 28 and a frame 30 arranged at least partially within the outer housing 28. An ink pad holder 32 is arranged within the frame 30 and an ink pad 34 is secured within the ink pad holder 32.

One or more springs 36 may be arranged between the ink pad holder 32 and the top of the outer housing 28 to facilitate proper depression of the self-inking stamp 26 when it is desired to create a segment of a design on a surface.

As shown in FIG. 3, reinking wells 38 are arranged beneath corresponding springs 36 so that ink may be supplied to the ink pad 34 as necessary. An elongated template 42 may extend along an inner wall of the frame 30 to facilitate proper movement of a marking platen 40. The marking platen 40 has the design formed on an outer face thereof. The design on the marking platen 40 is normally arranged adjacent to the ink pad 34 when the self-inking stamp is in a nondepressed position.

When it is desirable to form a segment of the design by using the self-inking stamp 26, the outer housing 28 should be depressed so that the marking platen 40 will flip over and the design formed on the face thereof will come in contact with the desired surface whereby a segment of the design will be formed on the surface to which it is applied. As discussed above in connection with the pre-inked stamp 10, the self-inking stamp 26 includes an alignment mechanism which is an important aspect of the present invention. In particular, the alignment mechanism includes a rectangular extended portion 27 having a cut-out registration design 29 at a preselected location thereon. The registration design 29 extends entirely through a selected area of the extended portion 27 to permit efficient and accurate alignment upon overlaying of the cut-out registration design 29 with respect to a previously formed design segment.

Figure 4:
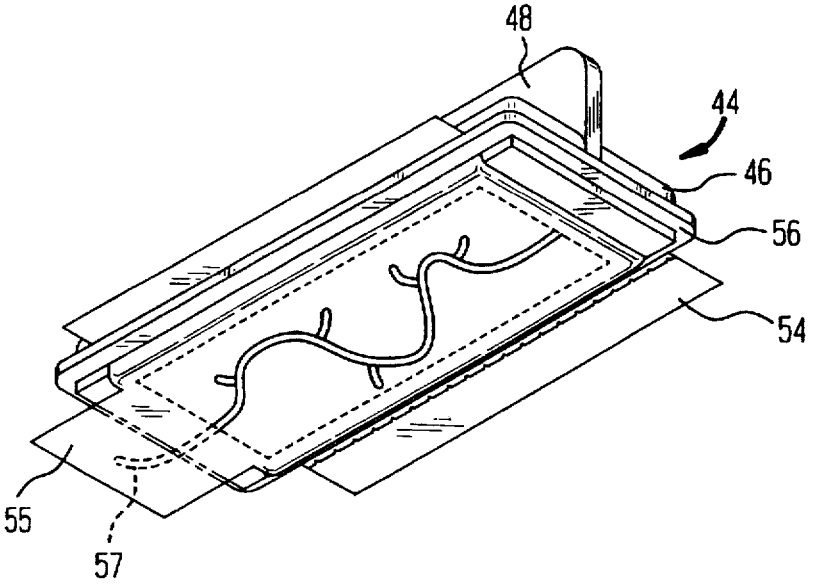
FIG. 4 is a bottom elevational perspective view of a third embodiment of a stamping device which can used with the method of the present invention.
Figure 5:
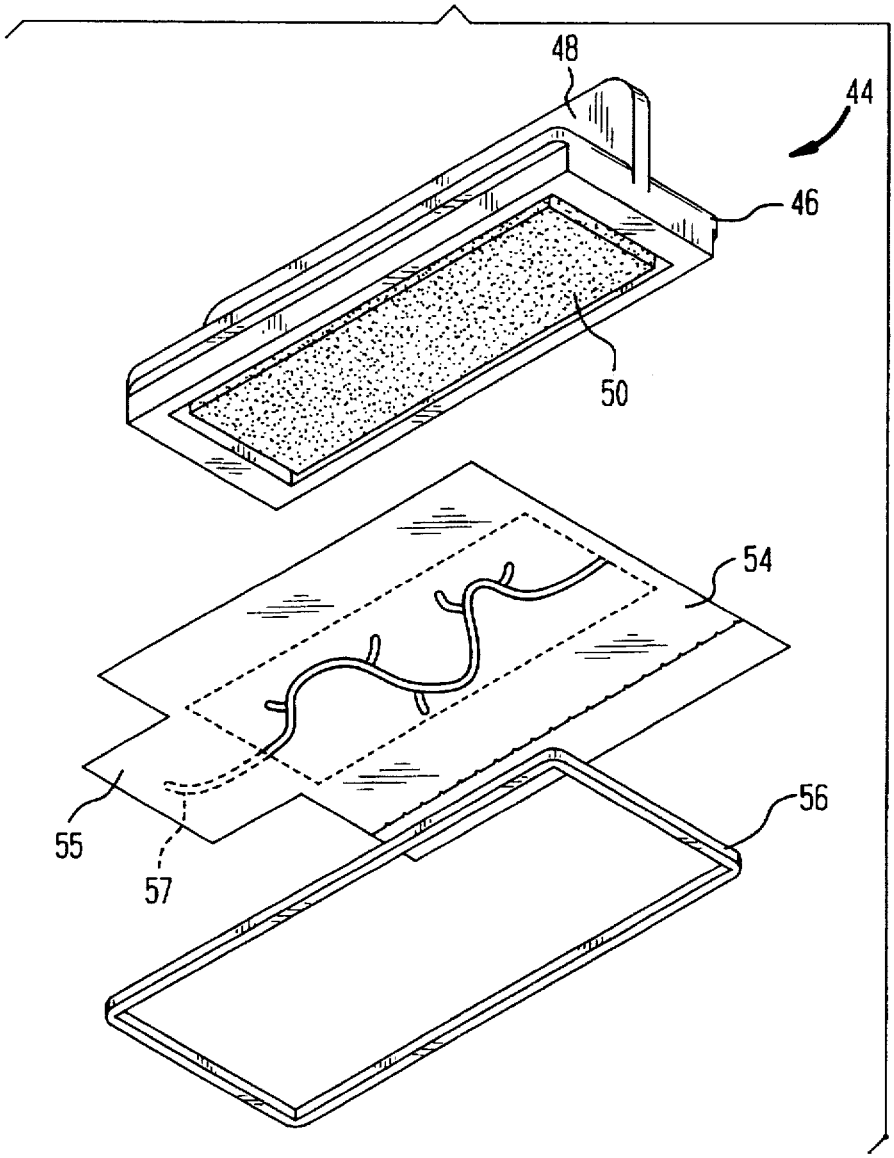
FIG. 5 is a partially exploded view of the stamping device shown in FIG. 4.

FIGS. 4 and 5 illustrate another embodiment of a stamping device that may be used in accordance with the method of the present invention. To this end, a hand operated stencil stamp is designated 44 in FIG. 4. An exploded view of the stencil stamp 44 is shown in FIG. 5 as comprising a base 46 and a handle 48 attached to the top portion of the base 46. An ink pad (i.e., an absorbent marking fluid application surface) 50 is arranged at the opposite side of the base 46 from the handle 48.

A stencil sheet 54 having a desired design thereon is removably mounted adjacent the ink pad 50. The stencil sheet 54 is secured in assembled position adjacent the ink pad 50 by a removable frame 56 which frictionally maintains the stencil sheet 54 in assembled position on the sides of the base 56 as shown in FIG. 4. In order to permit proper registration (i.e., alignment) of the stencil stamp 44 with an adjacent formed design segment, the stencil sheet 54 is provided with an extended portion 55 and a registration design 57 marked thereon at a preselected location. Since the stencil sheet 54 and the extended portion 55 thereof is preferably translucent, the marked registration design 57 can easily be aligned with an underlying portion of a design segment as the stencil stamp is selectively arranged so that the registration design 57 will overlay a previously formed design segment.

The hand operated stencil stamp 44 may be known in the industry as a hand duplicator and may include an ink well (not shown) for applying ink as necessary to the ink pad 50. Alternately, an ink reservoir (not shown) may also be use in combination with the hand operated stencil stamp 44 so that ink can be continuously supplied to the ink pad 50 as needed. The hand operated stencil stamp 44 shown in FIGS. 4 and 5 may be useful as desired to create a "repetitive" design. However, if an entirely "continuous" design is desired, an alternate embodiment of a hand operated stencil stamp may be used wherein the ink applying surface, such as ink pad 50, extends along the entire length of the stencil assembly base. The design of an associated stencil sheet, such as stencil sheet 54, would also be modified so that it extends along the entire length of the base 46 adjacent to the ink pad 50. The stencil sheet 54 should still include the extended portion 55 and the registration design mark 57 thereon in order to permit proper alignment of the stencil stamp 44 prior to forming a design segment adjacent to a previously formed design segment.

FIGS. 9A, 9B, 10A, 10B, 11, 12A and 12B show additional embodiments of stamping devices in accordance with the present invention. In particular, the stamping devices shown in FIGS. 9A, 9B, 10A and 10B include a rubber marking structure, to which paint may be externally applied, or a pre-inked marking structure or various other marking structures suitable for applying a marking fluid to a surface where a desired design is formed.

The stamping device 110 has a structure similar to the structure of pre-inked stamping device 10 shown in FIG. 1.

Figure 9A:
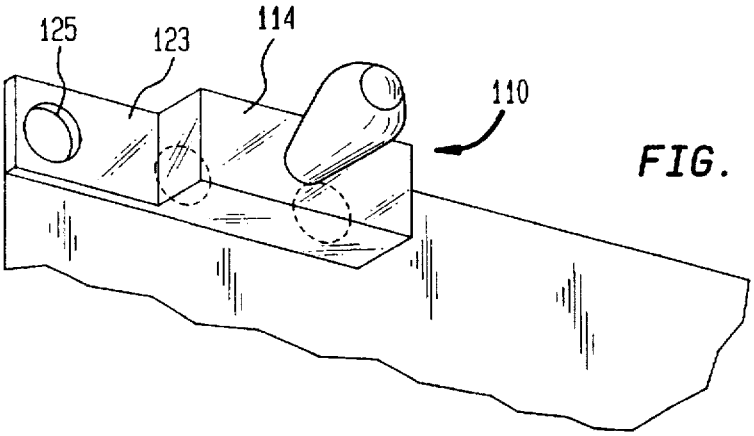
FIG. 9A illustrates a perspective view of another stamping device used to create a further design on a wall surface.
Figure 9B:
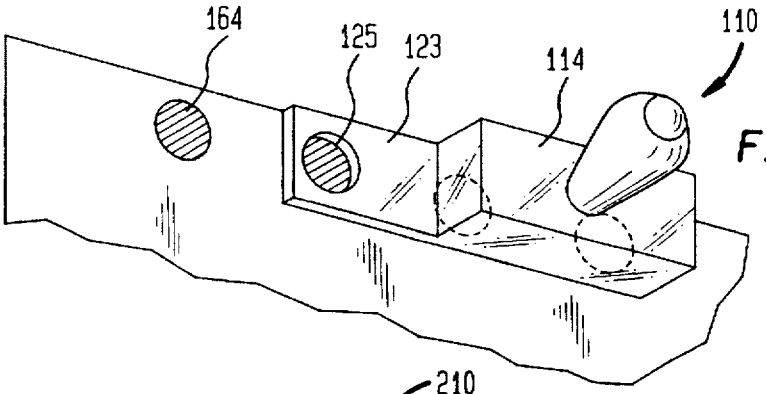
FIG. 9B illustrates the stamping device of FIG. 9A after a first segment of a first portion of the design was formed while overlaying a cut-out registration design over a portion of a previously formed adjacent design segment in order to obtain proper alignment of the stamping device.

In this regard, the stamping device 110 includes a casing 114 and a rectangular extended portion 123 attached at the base thereof. A registration design in the form of cut-out circle 125 is arranged at a preselected location on the extended portion 123 to facilitate alignment of the stamping device 110 with previous adjacent formed design segments 164. In this regard, the circular cut-out 125 is shown in FIG. 9B in an overlayed position with respect to a formed circular design segment 164. Depression of the stamping device 110, when it is in its aligned position, will result in the formation of a design segment entirely aligned with an adjacent design segment so that a desired continuous or substantially continuous final design may be obtain.

Figure 10A:
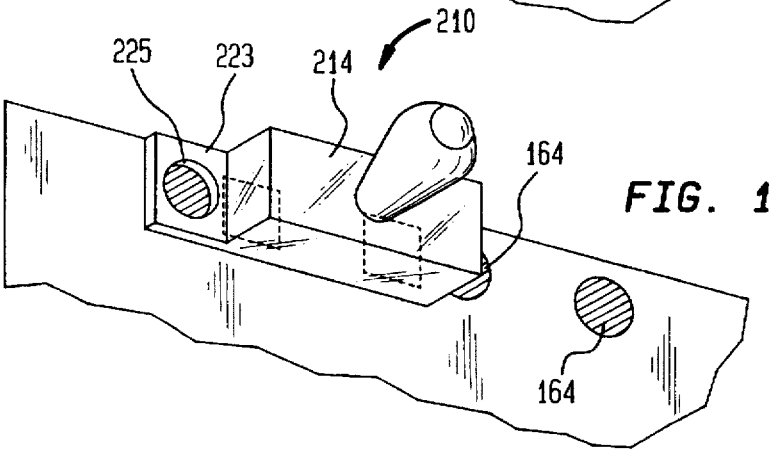
FIG. 10A illustrates a further stamping device used to create a second portion of a combined circle and square design with the registration design area overlayed above a portion of previously formed design segment prior to superimposing a second portion of the design.
Figure 10B:
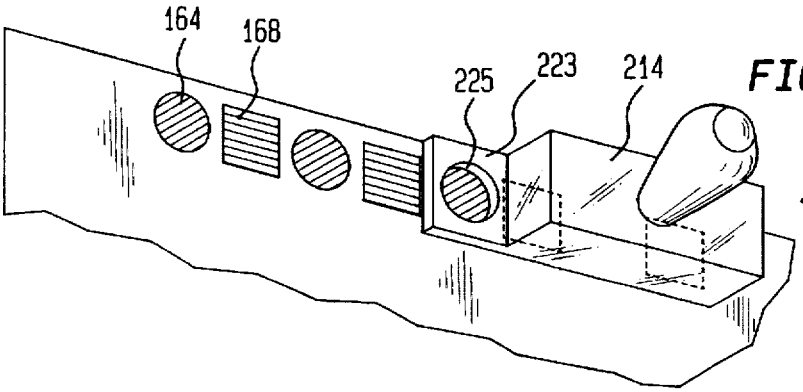
FIG. 10B illustrates the stamping device of FIG. 10A as it is being aligned to form a further segment of the second portion of the combined circle and square design.

As illustrated in FIGS. 10A and 10B, a stamping device 210 including an extended portion 223 and a cut-out registration design 225 includes square-shaped marking members thereon. The extended portion 223 is arranged to overlay a segment 164 of a previously formed design so that the cut-out registration design 225 will permit visual alignment of the stamping device 210, thus facilitating the formation of a perfectly aligned second design segment 168.

Figure 11:
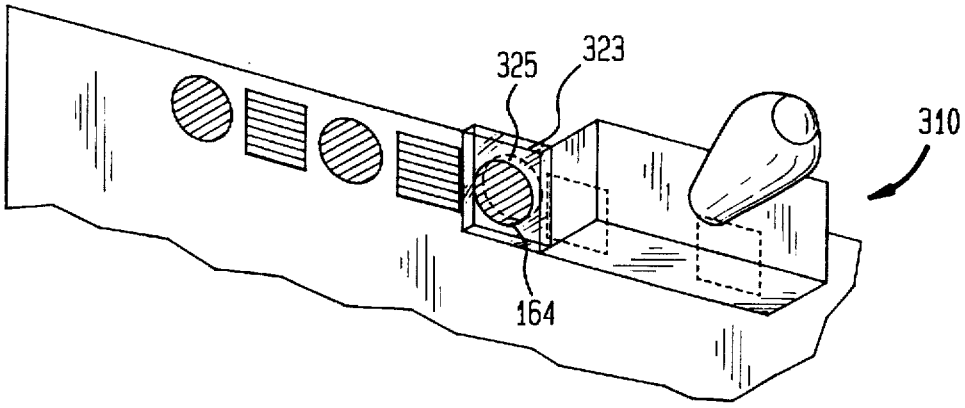
FIG. 11 illustrates yet another embodiment of a stamping device having a registration design arranged on a translucent extended portion attached to a casing of a stamping device.

FIG. 11 shows yet another embodiment of a stamping device 310 which includes an extended portion 323 connected to the base of the stamping device and a marked registration design 325 arranged at a preselected location on the extended portion 323. The extended rectangular portion 323 differs from the extended portions 123 and 223 of the embodiments shown in FIGS. 9A, 9B, 10A and 10B in that it is made of a translucent material, such as acrylic or the like. The registration design 325 may be simply marked on, by a writing implement, or etched by a laser device. The translucent nature of the extended portion 323 thus permits alignment of the stamping device 310 by using a marked registration design, as opposed to a cut-out registration design.

FIGS. 12A and 12B show yet further embodiments of stamping devices which can be used in accordance with the present invention. In particular, FIG. 12A illustrates that a stamping device 410 has an entirely translucent casing 414 which may be made of acrylic or the like. A handle (unnumbered) is connected to the casing to facilitate use of the stamping device. Rubber stamp impression members (i.e., indicia) forming a circular design (also unnumbered) are connected to the bottom of the translucent casing 414. The stamping device 410 also includes an extended portion 423. A marked registration design 425 is formed on the extension 423. In this embodiment, the marked registration design 425 may be formed by laser etching to a certain degree on the extension 423 of the casing 414. In this embodiment, it is not necessary for the etched registration design 425 to extend entirely through the extension 423 as the casing 414 is made of a translucent material, thus permitting alignment with at least a portion of previously formed circular design segment 164.

As illustrated in FIG. 12B, stamping device 510 also includes a translucent casing 514 with an extended portion 423 having a circular laser etched registration design 425 thereon. Stamping device 510 differs from the embodiment of the stamping device 410 in that the rubber marking members attached to the face of the casing 514 have a square shape. As illustrated in FIG. 12B, the overall formed design includes the combination of circular design segments 164 and square design segments 168. The marked registration designs 425 and 525 permit alignment with previously formed circular design segments 164.

In order to apply marking fluid to the circular and square rubber stamp marking members of the stamping devices 410 and 510, all that a user need do is dap the stamping devices onto an associated ink or paint retaining pad 74. The stamping device may then be used to transfer the marking fluid to the surface, such as a wall surface as shown in FIG. 12B.

Stamping devices other than those discussed above and shown in FIGS. 1–5, 9A, 9B, 10A, 10B, 11, 12A and 12B can be used in accordance with the method of the present invention. For example, a stamping device for supplying paint to the face of a stencil may also be used. Such a stamping device would include an absorbent paint applicator which may be placed adjacent to a stencil sheet prior to application of a design on a surface. Such an arrangement may be similar to known hand operated stencil assemblies except that it would also require an extended registration section which is adapted to overlay a previously formed design segment to obtain proper alignment. The absorbent paint applicator may be considered a paint applying substrate which may be used in place of a traditional ink pad such as ink pad 50. Various types of paint, such as acrylic paint or water based paint, may be applied to the absorbent paint applicator instead of traditional inks. The paint applying substrate may comprise a foam pad, or other absorbent material, having sufficient absorbency and resiliency, or any other type of sufficiently absorbent material for absorbing paint and applying it to a surface upon depression of a stamping device.

In accordance with the method of the present invention, a border design may be formed on a wall surface as shown in FIGS. 6A–6E, 7 and 8A–8B. A border design formed in accordance with the present invention is particularly attractive as the finished design is "painted" or "inked" directly onto a wall surface. Such designs have heretofore been typically accomplished by using flexible stencil sheets and paint brushes to hand paint various cut-out areas on the flexible stencils. Although the design formed by using such flexible stencils is quite attractive, it is particularly time consuming and tedious to repeatedly hand paint stencil designs on wall surfaces around a room border, or the surface of other objects, as has been done in the prior art. As discussed above, prior art efforts to use stamping devices to form designs on a wall have also been made but have shortcomings since there has not been an accurate, efficient and effective alignment mechanism. The method of the present invention permits a decorator to create the same type of desirable design as designs formed by the prior art method of using flexible stencils, while saving many hours of time and eliminating the need for the decorator to possess significant artistic ability.

In order to clearly appreciate the advantages obtained by using the present invention, it is helpful to fully understand how properly aligned stencil designs have been most commonly applied in accordance with prior art methods. When it was desired to form a multi-color design, a decorator would use a first flexible stencil sheet to create a first portion of a design having a first color upon a desired surface area. When the decorator completed the first portion of the design, he would then superimpose a second design portion, having a different color than the first design portion, on top of the first design portion along the entire length thereof.

When using the method of the present invention to create a design on wall surfaces around the border of a room, a first stamping device should be placed at a preselected segment area 62A within the border area 60 of a wall 58. The stamping device, such as pre-inked stamp 10, self-inking stamp 26, hand operated stencil stamp 44, stamping devices 110, 210, 310, 410, 510 or other stamps, may have an optional guide (not shown) thereon so that the stamping design is arranged at a desired distance from the ceiling of a room and at a selected initial location along the border area 60. The guide may comprise a precisely sized portion of the stamp casing, such as a portion of the base 14 of pre-inked stamp 10. The alignment guide may also comprise a spacer element, markings on an extended portion or any other feature which permits proper initial placement of the stamping device with respect to a preselected segment area. This initial placement guide may not be necessary in many applications where precise initial placement is not essential.

As discussed above, an important feature of the present invention pertains to the alignment mechanism of the stamping device which facilitate accurate and efficient alignment of the stamping device with a previously formed design segment. The alignment mechanism preferably comprises an extended portion of the stamping device having a registration design at a preselected location thereon. The registration design may be a cut-out entirely through the preselected location of the extended portion, or may be a marked design when the extended portion is at least substantially translucent. In operation, the extended portion of the stamp casing can easily be aligned at a proper overlaying position with respect to a previously formed design segment as the registration design thereon is arranged to permit complete visibility of the formed design segment.

Clear acrylic and other polymeric material which may be used to form suitable extended portions in accordance with one embodiment of the alignment mechanism of the present invention. When a substantially translucent material is used, the registration design may be formed thereon by various tools such as writing implements, standard etching implements, and laser devices. One preferred method of forming accurate registration designs, includes the use of a laser engraving device which effectively burns the registration design at a precisely desired location on an associated extended portion of the stamp casing. The laser device for forming a marked registration design, such as registration designs 325, 405 and 525 in FIGS. 11, 12A and 12B are not shown in the drawings.

Figure 6A:
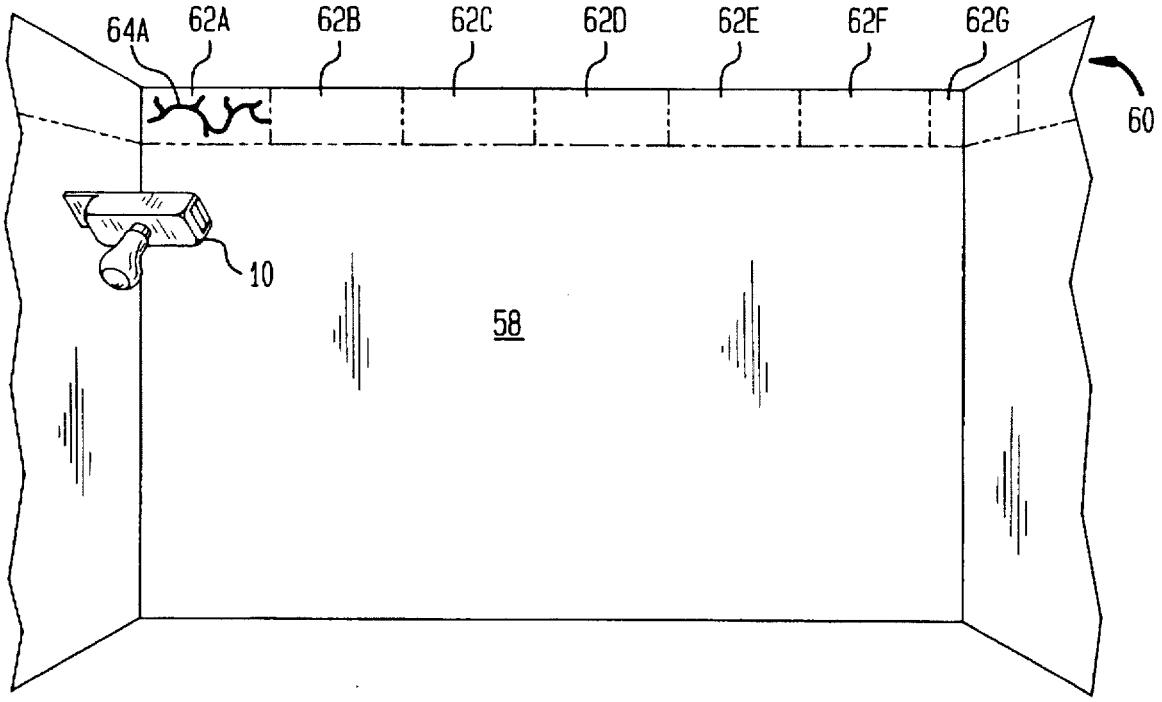
FIG. 6A illustrates a first segment of a first portion of a design applied to the border of a wall with the stamping device of FIG. 1 illustrated suspended above the formed first segment.
Figure 6B:
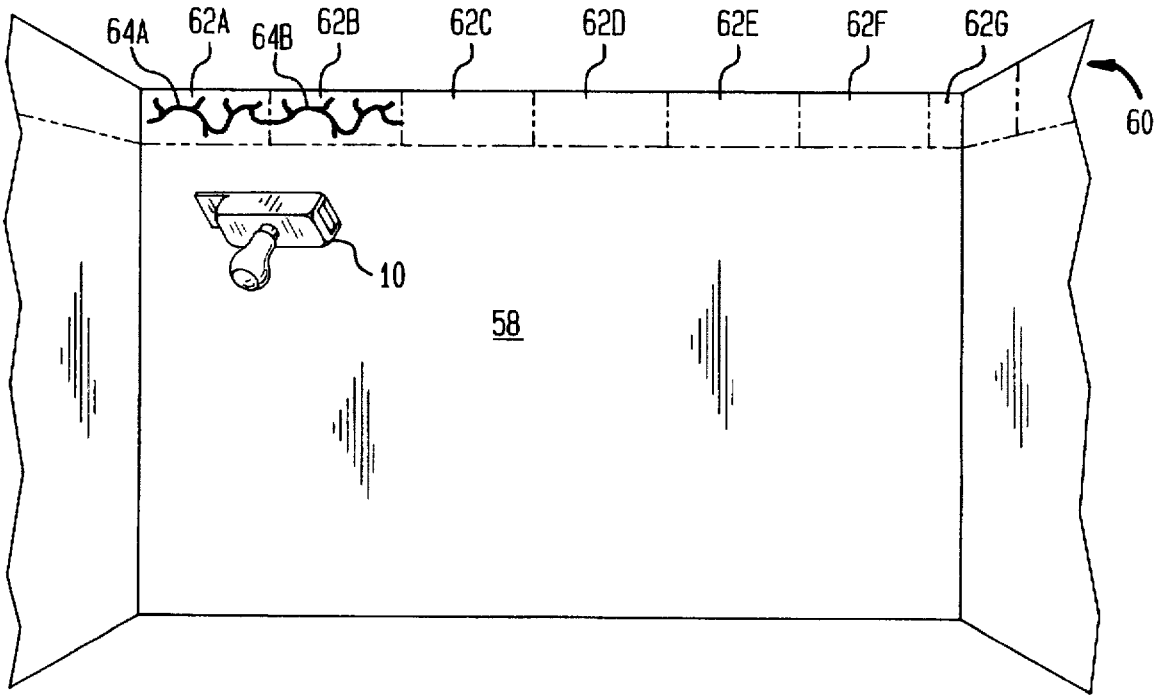
FIG. 6B illustrates a second segment of the first portion of the design shown in FIG. 6A with phantom lines illustrating that the second segment is formed adjacent to the first segment.

After alignment of the stamping device is completed, the decorator would then depress the stamping device so that a first segment 64A of a first portion of a design is formed at the preselected segment area 62A. As illustrated in FIG. 6A, a first segment of the first portion of the design may comprise the petals of a flower. As will be discussed further below, the overall desired design may include an ivy plant having brown stems, and green leaves. The stems of the ivy plant may comprise the first portion of the design and the leaves may comprise the second portion of the design. An ivy plant has been selected as an example of one type of design to describe use of the present method of creating a border design. It should be understood that the present method can be used to create an infinite variety of designs.

When using the method of the present invention to create a border design, it is preferable to complete the first portion of the design before the second portion of the design is superimposed thereon. However, in certain applications, it may be desired to superimpose a segment of the second portion of the design on top of a segment of the first portion of the design before the entire first portion is completed. When the method of the present invention is used in this manner, it is desirable to verify that the first portion of the design is dry before the second portion of the design is superimposed thereon.

When creating a border design, it is often desirable to place the segments of each portion of the design immediately adjacent a preceding segment so that the border design will be continuous along the entire border area 60 of a wall surface 58. After the first segment 64A of the first portion of the design is formed at the preselected segment area 62A, the stamping device (10, 26, 44, 110, 210, 310, 410 and 510) should be moved and the alignment mechanism including the extended portion of the stamp casing (23, 27, 123, 223, 323, 423 and 523) or of the stencil sheet (55) should be placed on top of previously formed design segment 64B so that the registration design (25, 29, 57, 125, 225, 325, 425 and 525) properly overlays such previous design segment in order to facilitate proper placement of the stamping device on segment area 62B adjacent to the first segment area 62A. The stamping device should then be depressed so that a second segment of the first portion of the design 64B is formed adjacent to first segment 64A. This aspect of the method of the present invention can be best appreciated with reference to FIG. 6B.

Figure 6C:
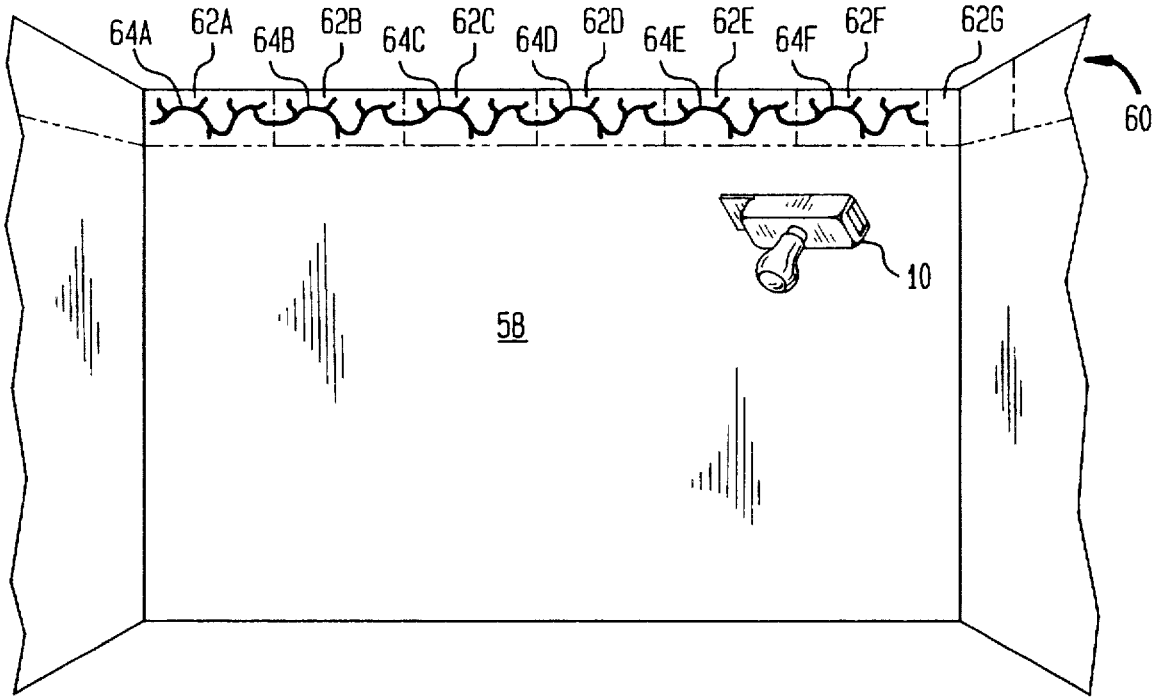
FIG. 6C illustrates a continuous strip of segments of the first portion of the design shown in FIGS. 6A and 6B along substantially the entire length of a wall with a small area of the wall border left without the design formed thereon between the end of the last segment and an adjacent wall.
Figure 6D:
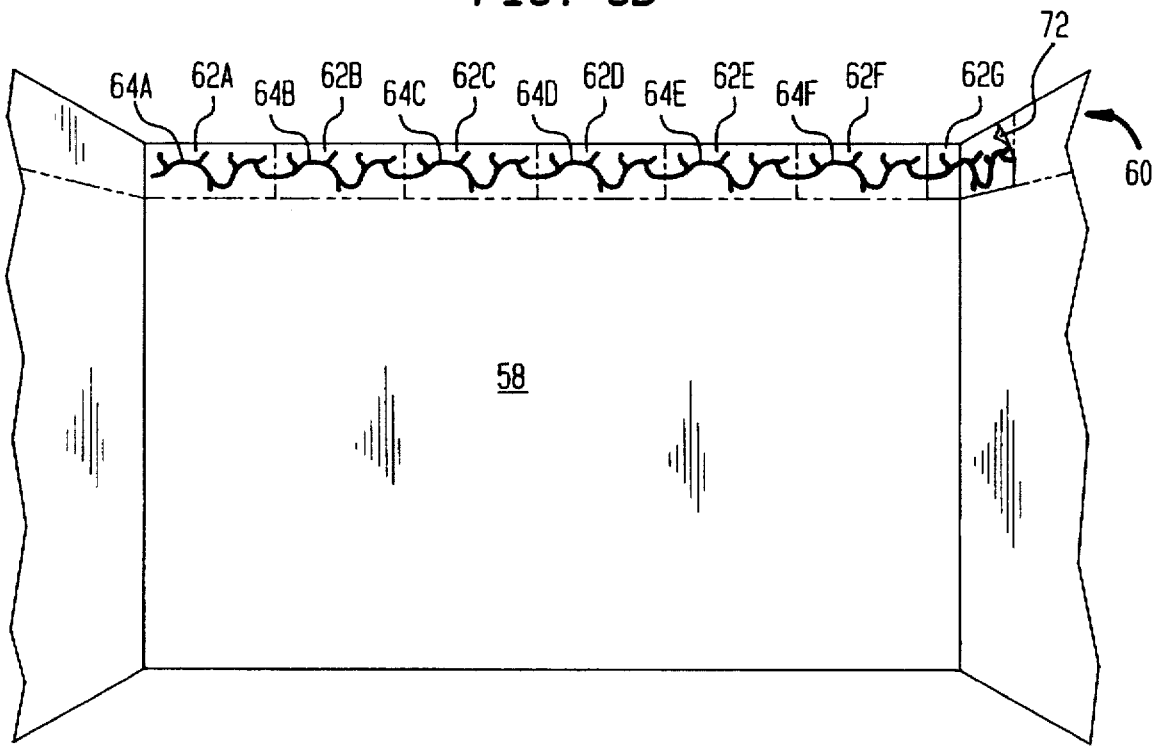
FIG. 6D illustrates the placement of a flexible stencil sheet over the wall area between the end of the last segment formed and the adjacent wall.

The steps of moving a stamping device to an adjacent segment area, overlaying to align the stamping device and depressing the stamping device to form additional segments of the first portion of the design should be repeated until at least substantially the entire first portion of the design is completed. As shown in FIG. 6C, segments 64A–64F of the first portion of the design have identical dimensions. Since each wall surface has a different length along the border area 60, a custom sized segment area 62G may remain between the end of the design segment 64F of the first portion of the design and an adjacent wall. The custom sized segment area 62G may be too small to accommodate an entire segment of the first portion of the design on an associated stamping device.

Figure 6E:
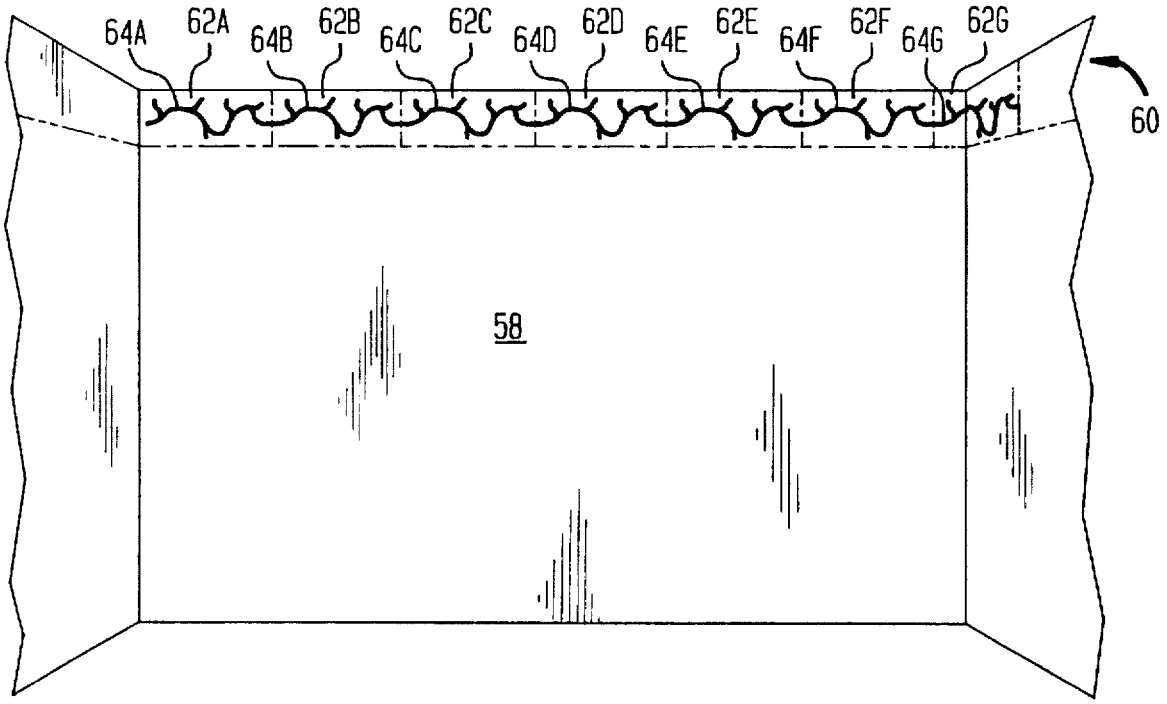
FIG. 6E illustrates a continuous strip of segments of the first portion of the design formed along the entire top border of the wall shown in FIGS. 6A–6D.

The method of the present invention contemplates various solutions to the problem of creating a properly sized design segment at the custom sized segment area 62G. One such solution includes the placement of a flexible stencil sheet 72, such as the flexible stencil sheets used in the prior art, on the wall at the custom sized segment area 62G. The flexible stencil sheet 72 may then be manipulated so that a decorator can apply a desired amount of ink or paint to a selected portion of the cut-out areas of the flexible stencil sheet 72 so that a custom sized design segment 64G is applied to the wall at the custom sized segment area 62G. A wall having an entire first portion of the design applied along the border area 60 is shown in FIGS. 6E.

After the first portion of the design is formed within the border area 60 of the first wall 58, the decorator may choose to continue to apply the first portion of the design around the border of the entire room. Thus, the steps of the method of the present invention discussed above should be repeated until the decorator has applied the first portion of the design to the entire desired area.

After the first portion of the design has been completed, the decorator may then begin superimposing the second portion of the design on the first portion thereof. As discussed above, the second portion of the design may comprise a different configuration and color than the first portion of the design. As shown by way of example in FIGS. 7, 8A and 8B, each segment of the second portion of the design comprises the leaves associated with the stems of the first portion of the design. It should be appreciated that in the description of the design discussed herein, the entire design only comprises two portions. However, the design may comprise only one portion, or may comprise a large number of portions superimposed on top of each other to create a final design. Additionally, each portion of the design may comprise a different color. However, it may be desirable in some applications for various portions of the design to comprise the same color.

Figure 7:
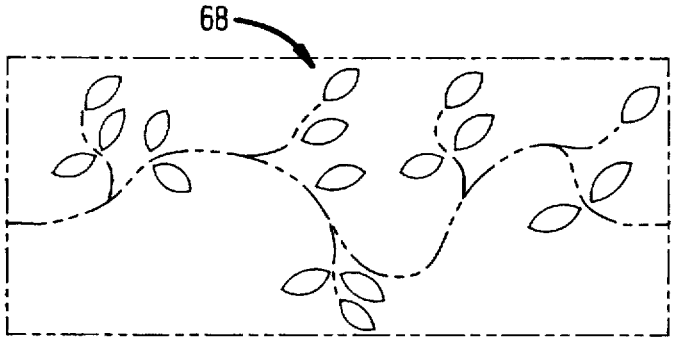
FIG. 7 illustrates an isolated first segment of a second portion of a design with the corresponding first segment of the first portion of the design shown in phantom.

FIG. 7 illustrates plant leaves in accordance with a segment of the second portion of the design. A segment of the first portion of the design (i.e., plant stems) are shown in phantom so that the superimposed relationship between a segment of the first and second portions of the design can be appreciated.

Figure 8A:
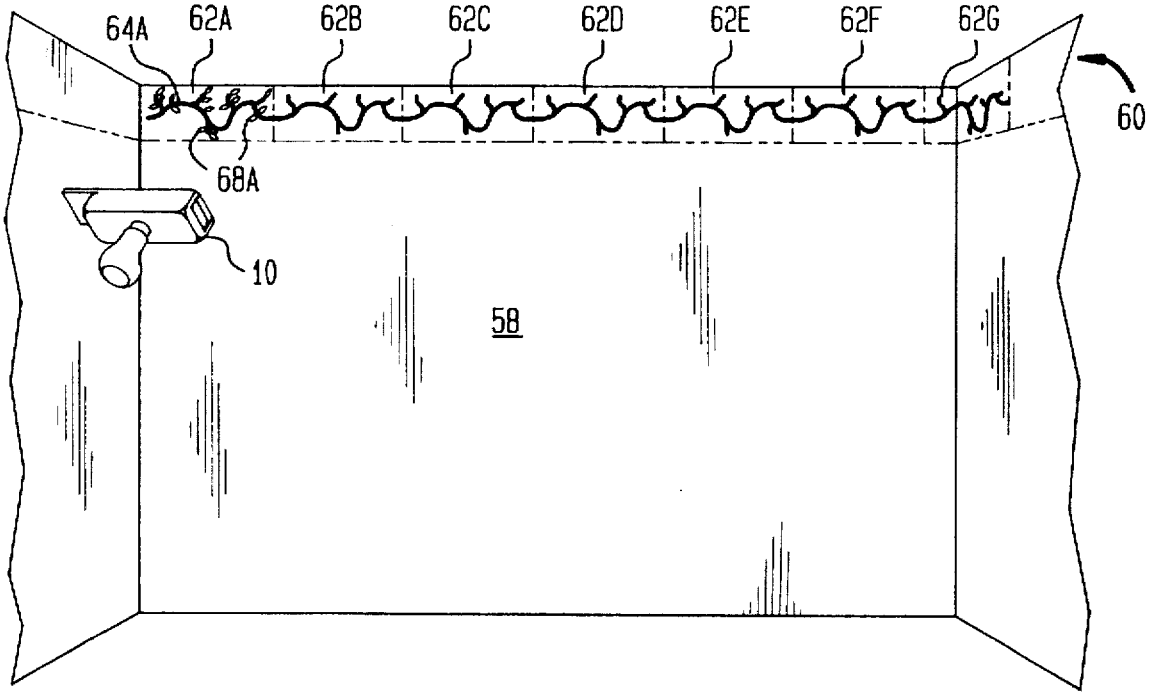
FIG. 8A illustrates the resulting design after the first segment of the second portion of the design is superimposed on the first segment of the first portion of the design while the remaining segments of the second portion of the design have not yet been superimposed with the corresponding segments of the first portion of the design.

FIG. 8A illustrates a first segment 68A of the second portion of the design after it has been superimposed on the first segment 64A of the first portion of the design within the border areas 60. At this stage of the method of the present invention, the additional segments of the second portion of the design have not yet been applied to the first portion of the design. Segments 68B–F of the second portion of the design are identical to each other and may be superimposed upon corresponding segments 64B–64F of the first portion of the design. The steps of superimposing the segments of the second portion of the design onto the segments of the first portion of the design may be easily performed simply by placing the extended portion 23 of a stamping device, such as the stamping devices shown in FIG. 1–6, over the corresponding segments of the first portion of the design until proper alignment of the registration design 25 is obtained with the underlying formed design segment and thereafter depressing the stamping device. The stamping device must be properly aligned prior to depression thereof in order to properly superimpose segments 68A–F of the second portion of the design on corresponding segments 64A–F of the first portion of the design. The decorator may easily accomplish such alignment by placing the extended portion of the stamping device and the registration design thereon a selected overlying position with respect to a previously formed segment of the first and second portions of the design.

In a preferred embodiment of the present invention, the stamping device will have an alignment mechanism including an extended portion connected to a portion of the casing with a registration design thereon so that the decorator can easily accomplish proper alignment before depressing the stamping mechanism and forming design segments. Several types of alignment mechanisms are discussed above including opaque and translucent extended portions with cut-out and marked registration designs. Although the structure of the alignment mechanism may vary in alternate embodiments, each alignment mechanism should permit the decorator to place the stamping device at a selected position with respect to a previously formed design segment or a selected segment area so that proper registration and placement of design segments can be obtained. In accordance with the preferred embodiments of the present invention, such alignment mechanisms do not require external tools or devices, such as hooks, chains, chalk lines and the like.

In order to superimpose custom sized segment 68G of the second portion of the design on top of custom sized segment 64G of the first portion of the design, a decorator may use an additional flexible stencil sheet which has a segment of the second portion of the design thereon. This flexible stencil sheet will be similar to flexible stencil sheet 72, except that the design corresponds to the second portion of the design, instead of the first portion of the design. As indicated above, flexible stencil sheet 72 may be the same type of flexible stencil sheet used in the prior art. Flexible stencil sheet 72 is preferably transparent so that the decorator can easily see registration marks thereon to facilitate placement of the stencil sheet in its proper aligned position prior to application of a selected ink or paint so that proper superimposition of the custom sized segment of the first and second portions of the design can be obtained.

Figure 8B:
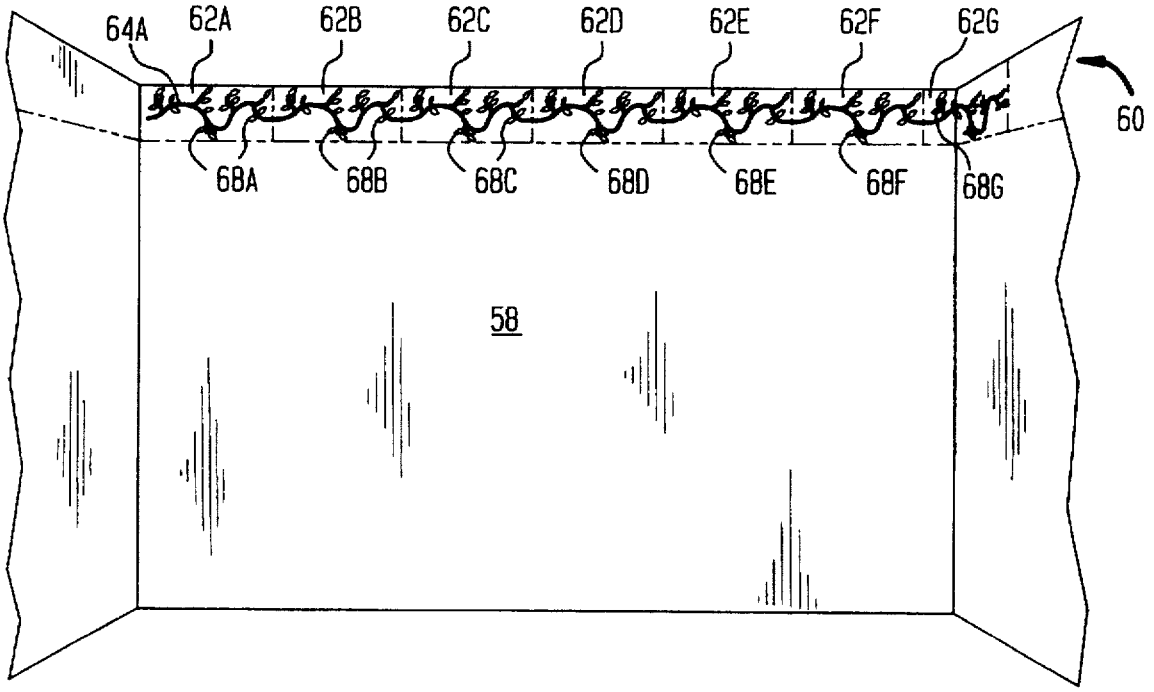
FIG. 8B illustrates a completed design along the border of one wall after corresponding segments of the second portion of a two-part design are superimposed on the segments of the first portion of the design.

FIG. 8B illustrates a completed wall border with both the first and second portions of the design applied thereto in accordance with the method of the present invention. By using stamping devices having the alignment mechanism of the present invention to apply the design to at least a majority of the border area 60, a decorator can complete the application of a "stencil" design on a wall surface in a fraction of the time that was required when using the prior art method. Additionally, since there is little skill involved in overlaying a clear registration design with a corresponding portion of a previously formed design segment, and in subsequently depressing a stamping device, the decorator need not have a great deal of artistic ability in order to create designs having a pleasing appearance on a surface.

The method of present invention also contemplates using a stamping device to form the custom sized design segments of the first and second portions of the design. To this end, a sheet of paper or other suitable blank insert material may be arranged beneath the portion of the design indicia on the stamping device which the decorator does not wish to apply to the custom sized segment area. The stamping device should then be depressed so that only the portion of the design that is not arranged over the paper will be applied to the custom sized design segment area.

In certain applications, the decorator may choose to center the design on the border area so that a small unstamped area is left on both sides of a wall. In this embodiment, it will not be necessary to use a flexible stencil sheet, or a stamping device in combination with a blank insert, as the custom sized design segment is not required.

In applications where it is desired to apply a design to surfaces other than the border of a wall, it may be necessary to use a flexible stencil sheet in combination with a stamping device to complete the design along the entire surface as desired in accordance with the method discussed above.

It should be appreciated that various modifications to the steps of the present method, and structure of the stamping devices, and the inks and paints which may be used in accordance with the present invention are encouraged. Thus, the present invention is not intended to be limited to the description set forth above, but is defined by the claims set forth below.

What is claimed is:

1. A method of forming a design on a wall, said method comprising the steps of: selecting a wall surface on which a design is to be formed; placing a stamping device having a registration design thereon at a selected location on said wall surface; depressing the stamping device against said wall surface at said selected location so that a segment of a first portion of said design is formed; moving the stamping device to a different selected location on said wall surface spaced a desired distance from the previously formed segment at the previous selected location and overlaying a portion of said stamping device including said registration design above at least a portion of the previously formed segment so that said stamping device is aligned with the previously formed segment; depressing the stamping device against said wall surface at said different selected location so that an additional segment of said first portion of said design is formed; and repeating said steps of moving and aligning the stamping device at a different selected location with respect to previously formed segments of the design and depressing the stamping device until a desired length of said first portion of said design is completed on said wall surface.

2. The method of claim 1 wherein said first portion of said design is substantially continuous along the entire surface of the wall on which it is formed.

3. The method of claim 1 wherein each segment of said first portion of said design is formed substantially adjacent at yeast one other segment of said design.

4. A method of forming a border design on one or more walls of a room, said method comprising the steps of: selecting a portion of a wall on which the border design is to be formed; placing a stamping device having a registration design thereon at a selected location on the surface of the selected portion of the wall; depressing the stamping device against said wall surface at the selected location so that a segment of a first portion of said border design is formed; moving the stamping device to a different selected location on said wall surface spaced a desired distance from the previously formed segment at the previous selected location and overlaying a portion of said stamping device including said registration design above at least a portion of the previously formed segment so that said stamping device is aligned with the previously formed segment; depressing the stamping device against said wall surface at said different selected location so that an additional segment of said first portion of said border design is formed; and repeating said steps of moving and aligning the stamping device at a different selected location with respect to previously formed segments of the design and depressing the stamping device until a desired length of said first portion of said border design is completed on the wall surface.

5. The method of claim 4 wherein each segment of said first portion of said border design is formed substantially adjacent at least one other segment of said border design.

6. The method of claim 5 wherein said border design is formed on at least two walls of the room.

7. The method of claim 6 further comprising the steps of determining the distance between the end of the last segment of said first portion of said border design formed on a wall and an adjacent wall, where it is desired to form a custom sized segment of said border design; placing an additional design forming device on the wall surface over the determined distance where it is desired to form the custom sized design segment; and forming the custom sized design segment on the wall surface whereby the at least one first portion of said substantially continuous design is completed along the entire surface of the wall.

8. The method of claim 7 wherein the additional design forming device comprises a flexible stencil sheet having the desired custom sized design segment thereon, said steps of placing the additional design forming device on the wall surface and applying the custom sized design segment comprises arranging the flexible stencil sheet at the desired location on the wall and applying a marking composition over at least a portion of the flexible stencil sheet so that said custom sized design segment is formed on the wall surface between the end of a previously formed design segment and an adjacent wall so that said first portion of said substantially continuous border design is completed on the wall surface on which it is formed.

9. The method of claim 7 further comprising the step of placing the stamping device at a selected location on the wall surface of a wall adjacent the wall to which said substantially continuous border design is formed, said selected location being adjacent said substantially continuous border design; and depressing the stamping device against the wall surface at said selected location so that an additional segment of said at least a first portion of said border design is formed whereby the length of at least said first portion of said substantially continuous border design is increased.

10. The method of claim 7 wherein the steps of placing the stamping device at a selected location and depressing the stamping device is repeated until said substantially continuous first portion of said border design has been formed on the walls around substantially the entire perimeter of the room.

11. The method of claim 4 wherein said border design comprises a plurality of portions, each of said portions including a different color which will form part of a multi-color border design; said method further comprising superimposing at least a second portion of said substantially continuous border design on said first portion so that said substantially continuous multi-color border design is completed on at least one of the walls.

12. The method of claim 11 wherein said step of superimposing at least a second portion of said substantially continuous border design comprises initially placing and aligning a second stamping device at a preselected location on top of a segment of said first portion of said border design; depressing the second stamping device so that a segment of said second portion of said border design is superimposed at said preselected location on said selected segment of said first portion; and, if necessary, repeating said steps of placing, aligning and depressing the second stamping device on top of corresponding segments of said first portion of said border design until said second portion of said substantially continuous border design is completed.

13. The method of claim 7 wherein said border design comprises a plurality of portions, each of said portions including a different color which will form part of a multi-colored border design; said method further comprising superimposing at least a second portion of said substantially continuous border design on said first portion so that said substantially continuous multi-colored border design is completed on at least one of the walls.

14. The method of claim 13 wherein said step of superimposing at least a second portion of said substantially continuous border design comprises initially placing and aligning a second stamping device at a preselected location on top of a selected segment of said first portion of said border design; and depressing the stamping device so that a segment of said second portion of said border design is superimposed at said preselected location on said selected segment of said first portion.

15. The method of claim 14 wherein said second portion of said border design is substantially continuous and additional portions of said border design having different colors from said first and second portions, are formed if necessary along said first and second portions, until the entire desired border design is completed.

16. A method of forming a continuous multi-colored design having a repetitive pattern on a surface comprising the steps of: selecting a surface on which a multi-colored design is to be formed; placing a first stamping device at a selected location on said surface; depressing the first stamping device against said surface at the selected location so that a segment of a first portion comprising a first color of said design is formed; moving the first stamping device to a second selected location at a desired distance from the previous selected location where the previous segment of said first portion of said design was formed and overlaying a portion of said stamping device including a registration design above at least a portion of the previously formed segment so that said stamping device is aligned with the previously formed segment; depressing the first stamping device at said second selected location so that a second segment of said first portion of said design is formed;

repeatedly moving and aligning by overlaying the first stamping device adjacent to a previously formed segment of said first portion of said design and depressing the first stamping device until a desired length of said first portion of said design is completed; placing a second stamping device at a preselected location on top of a segment of said first portion of said design; depressing the second stamping device so that a segment of said second portion is superimposed on the selected corresponding segment of said first portion, wherein the second portion comprises a different color than said first portion; and repeatedly moving and aligning the second stamping device on top of an additional segment of said first portion of said design adjacent to a previously formed segment of the second portion of said design and depressing said second stamping device until a desired length of said second portion of said design is completed whereby two colored portions of said multi-color design is formed.

17. The method of claim 16 further comprising the steps of placing one or more additional stamping devices at a preselected location on top of said first and second segments of said first and second portions of said design; and depressing said one or more additional stamping devices so that additional colored portions of said design is formed until said multi-colored design is completed.

18. A stamping device for forming a design on a surface, said stamping device comprising:

An impression member for forming design segments on a surface; and a casing connected to said impression member, said casing including an extended portion extending beyond said impression member, said extended portion having a registration design thereon adapted to overlay at least a portion of a previously formed design segment for facilitating the alignment of said stamping device with the previously formed design segment.

19. The stamping device of claim 18 further comprising a handle attached to said casing for facilitating grasping of said stamping device and formation of design segments.

20. The stamping device of claim 18 wherein said registration design comprises a cut-out design arranged to extend through a pre-selected location of said extended portion to permit a user of said stamping device to visually register said stamping device with at least a portion of a design segment prior to depressing said stamping device.

21. The stamping device of claim 18 wherein said extended portion of said casing comprises a substantially translucent material, said registration device comprising a marked design at a preselected location on said extended portion.

22. The stamping device of claim 18 wherein said impression member comprises a rubber marking structure.

23. The stamping device of claim 18 wherein said impression member comprises a pre-inked microporous marking structure.

24. The stamping device for forming a design on a surface, said stamping device comprising:

A body; an absorbent marking fluid application surface arranged on said body; a stencil sheet removably attached to said body and arranged adjacent to said marking fluid applying surface, said stencil sheet including at least one cut-out design area for permitting a design to be formed on a surface by the application of marking fluid retained within said absorbent marking fluid application surface, said stencil sheet further including an extended portion extending beyond the perimeter of said body, said extending portion having a registration design thereon adapted to overlay at least a portion of a previously formed design segment for facilitating the alignment of said stamping device with the previously formed design segment.

25. The stamping device of claim 24 further comprising a handle attached to said body for facilitating grasping of said stamping device by a user.

26. The stamping device of claim 24 wherein said registration design comprises a cut-out design arranged at a preselected location of said extended portion of said stencil sheet.

27. The stamping device of claim 24 wherein said registration design comprises a marked design arranged at a preselected location of said extended portion of said stencil sheet.

* * * * *